United States Patent [19]

Lam et al.

[11] Patent Number: 4,773,971

[45] Date of Patent: Sep. 27, 1988

[54] THIN FILM MANDREL

[75] Inventors: Si-Ty Lam, San Jose; Glenn W. Weberg, Mt. View, both of Calif.

[73] Assignee: Hewlett-Packard Company, Palo Alto, Calif.

[21] Appl. No.: 925,450

[22] Filed: Oct. 30, 1986

[51] Int. Cl.[4] ..... C25D 1/08

[52] U.S. Cl. ..... 204/11; 204/281

[58] Field of Search ..... 204/11, 281, 192.3, 204/192.32

[56] References Cited

U.S. PATENT DOCUMENTS

| | | | |
|---|---|---|---|
| 3,703,450 | 11/1972 | Bakewell | 204/11 |
| 3,833,482 | 9/1974 | Jacobus | 204/11 |
| 3,847,776 | 11/1974 | Bourdon | 204/192.3 |
| 4,549,939 | 10/1985 | Kenworthy | 204/281 |

FOREIGN PATENT DOCUMENTS

| | | | |
|---|---|---|---|
| 947224 | 5/1974 | Canada | 204/11 |

*Primary Examiner*—T. M. Tufariello

*Attorney, Agent, or Firm*—William J. Bethurum

[57] ABSTRACT

A reusable mandrel and method of making a reusable mandrel is presented. This mandrel has a substrate with a conductive film layer. Upon the conductive film layer, a dielectric mold resides. An etched thin film mandrel is also presented. This mandrel has a substrate covered with a conductive film layer. This conductive film layer is etched to form a mold for the device to be manufactured. These mandrels facilitate the manufacture of high quality precision devices. In particular, they can be used to manufacture orifice plates for thermal ink jet printers by electrodeposition process.

8 Claims, 10 Drawing Sheets

THIN FILM MANDREL

FIELD OF THE INVENTION

The invention relates to the field of electroplating. In particular, this invention relates to the field of manufacturing mandrels using thin film processes. Additionally, this invention manufactures devices by electroforming a metal layer on to the mandrel.

BACKGROUND OF THE INVENTION

U.S. Pat. No. 3,703,450 describes a method for making a precision conductive mesh screen. First, this method constructs a mandrel. The prior-art mandrel is constructed by placing a master plate with the screen pattern on the glass substrate and by vapor depositing a thin film through the interstices of the master plate to form the screen's pattern on the glass. After removing the master plate from the glass substrate, the method deposits photoresist over the entire glass plate. Next, the method exposes and develops the photoresist to produce a layer of thin film in a screen pattern covered with a layer of photoresist in the same screen pattern. Next, the method deposits silicon monoxide on the entire glass substrate and removes the silicon monoxide and photoresist from the thin film pattern. This non-reusable mandrel is now ready for manufacturing the screen. This prior-art mandrel has several disadvantages. It cannot manufacture small geometry devices as pointed out in U.S. Pat. No. 4,549,939 discussed below. Also, the complicated prior-art process for making this mandrel has low yields.

U.S. Pat. No. 4,549,939 describes another prior-art thin film mandrel and the method of making it. This prior-art process constructs the prior-art mandrel by forming a stained pattern shield on a glass substrate and depositing a conductive and transparent thin film onto the substrate. Next, the prior-art method coats the thin film with resist and shines a light through the glass substrate and the transparent thin film to expose the unshielded photoresist. Finally, the photoresist is developed and forms the mold for electroforming. The prior-art mandrel formed by this process has several disadvantages. It is non-reusable and of poor quality due to resist broken after the electro-forming cycle. Additionally, it requires the use of a conductive thin film that is transparent; a costly and exotic material.

U.S. Pat. No. 4,528,577 describes another prior-art mandrel and the method of making it. This prior-art method of manufacturing orifice plates for thermal ink jet printheads electroforms nickel onto a stainless steel mandrel plate that contains either a pre-etched orifice pattern or a photoresist orifice pattern. Unfortunately, stainless steel mandrel plates always contain a large number of scratches and defects. These scratches and defects arise from characteristics of the stainless steel material and from the manufacturing process. The scratches and defects, which can not be eliminated, degrade the quality of the orifice plates manufactured from stainless steel mandrels. These inferior orifice plates produce inferior print quality. The method and apparatus in accordance with the present invention obviate these problems with mandrels in the prior art.

SUMMARY OF THE INVENTION

According to the present invention, the reusable mandrel has a glass substrate with a conductive film layer and dielectric layer. The dielectric layer has been etched to form a mold. According to the present invention, the method of making a reusable mandrel deposits a conductive film, such as a metal film, on a smooth substrate such as a polished silicon wafer, a glass substrate, or plastic substrate. Next, the method forms a mold by depositing a dielectric film on the metalized substrate, by using a standard photolithography process to define a resist pattern on the dielectric film, and by removing the unmasked dielectric film with a plasma etching process. Finally, the method strips the photoresist away and the mandrel is ready to use.

According to the present invention, another embodiment is the etched thin film mandrel which has a glass substrate and a conductive film layer. The conductive film layer has been etched to form a mold. According to the present invention, the method of making an etched thin film mandrel deposits a conductive film on a smooth substrate such as a polished silicon wafer or a glass substrate or plastic. Next, the method forms a thin film mold by using a standard photolithography process to define a photoresist pattern on the thin film and by etching the thin film unmasked by the photoresist pattern. Finally, the method strips the photoresist away and the mandrel is ready to use.

According to the present invention, a method manufactures high quality precision devices using the thin film mandrels. The thin film mandrels can be either the reusable mandrel or the etched thin film mandrel. This method electroforms metal on the etched thin film mandrel or the reusable mandrel that has the mold necessary for forming the device. The etched thin film of the etched mandrel becomes a permanent part of the device. However, the reusable mandrel is ready for another electroforming cycle once the device is removed from the mandrel.

The thin film mandrel has the advantage of producing high quality precision devices. This advantage results from the defect free surface of the thin film and the precision molds created by standard photolithography and etching processes. Additionally, the thin film mandrel has the advantage of producing high quality precision devices cheaply. This advantage results from the low cost procedures used to produce the mandrel and the low cost procedures for using the mandrel. The thin film mandrels are capable of producing a wide variety of devices. Devices traditionally manufactured by precision machining techniques such as laser machining, mechanical machining, and chemical etching can be manufactured by an electroforming process using the thin film mandrel. The electroforming process using the thin film mandrel produces devices having the same or better quality as those produced by precision machining and the thin film process produces the devices at a much lower cost.

Ink jet printhead performance depends on the quality of the orifice plates. High quality orifices yield high quality printing. Thus, this invention has the advantage of producing high quality precision orifice plates for ink jet printers that result in higher print quality. Additionally, the thin film mandrel can be used to manufacture components for other types of printers or for medical devices.

DETAILED DESCRIPTION OF THE INVENTION

Figure 1A:
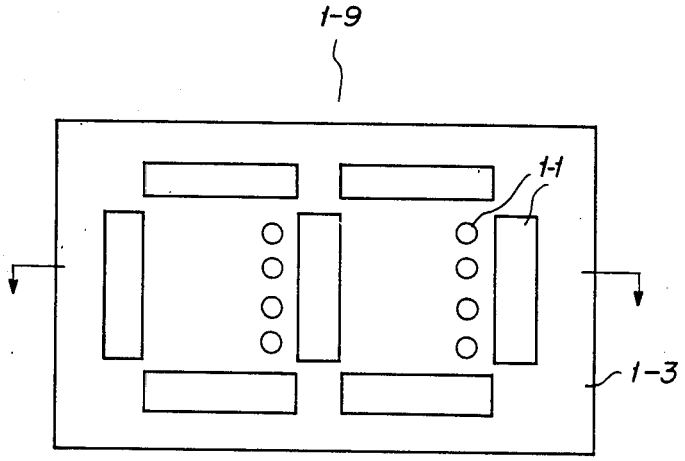
FIGS. 1A–1B show a reusable mandrel.
Figure 1B:
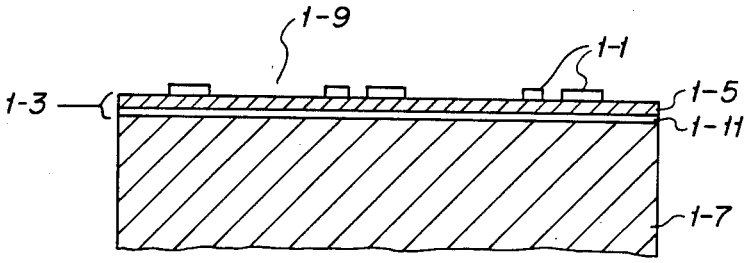

FIGS. 1A and 1B show the reusable mandrel 1-9. It has a conductive thin film layer 1-3 deposited on a glass substrate or a polished silicon wafer or a plastic substrate 1-7. This conductive thin film 1-3 can range from 100 angstroms to 200 microns. In alternate embodiments of the reusable mandrel a conductive thick film layer could be used in place of a conductive thin film layer. The thick film layers can range from 25 microns to 10 millimeters in thickness, however layers having other thickness ranges are possible. The film layer 1-3 has a layer of chrome 1-11 and a layer of stainless steel 1-5. The chrome layer 1-11 bonds firmly to the substrate 1-7 and provides a surface that the stainless steel layer 1-5 can adhere to. A dielectric layer 1-1 resides on top of the film layer 1-3. This dielectric layer 1-1 has been patterned and etched to form a mold.

Figure 2A:
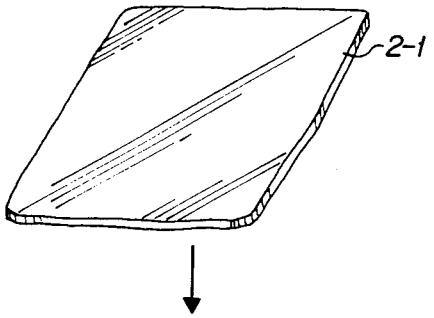
FIGS. 2A–2G show the steps used to manufacture a reusable mandrel.
Figure 2B:
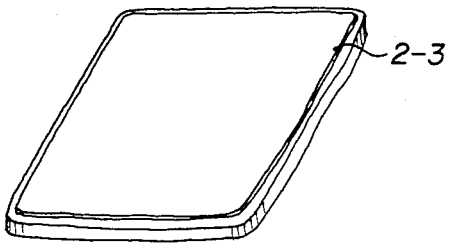
Figure 2C:
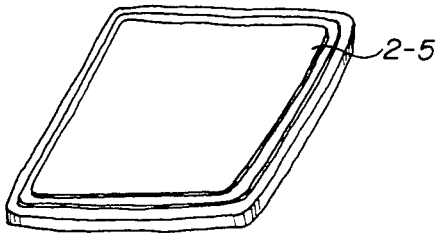
Figure 2D:
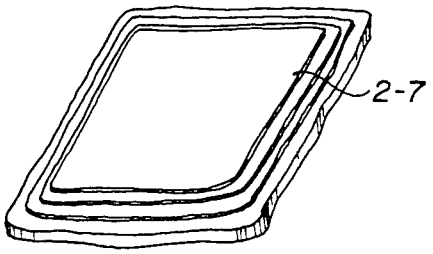
Figure 2E:
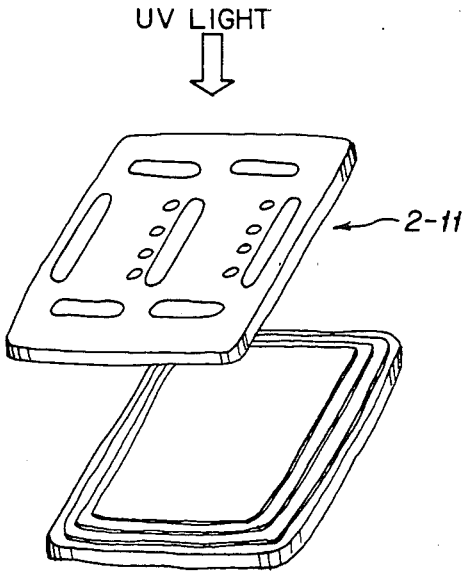
Figure 2F:
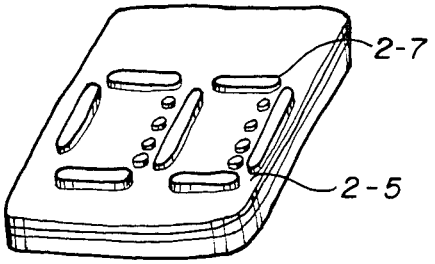
Figure 2G:
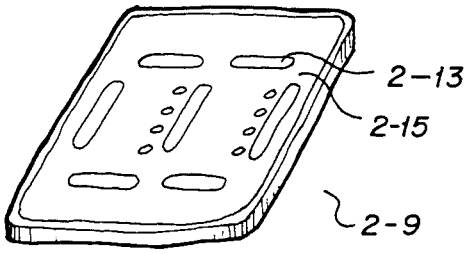

The process for manufacturing a reusable mandrel shown in FIGS. 2A–2G starts with a glass substrate or a silicon wafer, or a polished silicon wafer, or a plastic or any smooth, nonconducting surface 2-1 as shown in FIG. 2A. A vacuum deposition process, such as the planar magnetron process, deposits a conductive thin film 2-3. This thin film 2-3 is constructed from chrome and stainless steel materials. However, alternate embodiments could use different conductive materials. Another vacuum deposition process deposits a dielectric layer 2-5 on to the thin film layer 2-3. The preferred embodiment of the present invention uses a plasma enhanced chemical vapor deposition process to deposit a dielectric layer 2-5 of silicon nitride. However, alternate embodiments could use different nonconductive materials. Next, a photoresist layer 2-7 is applied to the dielectric layer 2-5. Depending on the photomask 2-11, either positive or negative photoresist is applied to the dielectric layer 2-5. Next, the photomask 2-11 is placed next to the photoresist layer 2-7 and exposed to ultra violet light as shown in FIG. 2E. Next, the photoresist layer 2-7 is developed to obtain the photomask 2-11 pattern into the photoresist layer 2-7. This patterned photoresist layer 2-7 serves as a mask for the dielectric layer 2-5. Next, an etching process, such as plasma etching, removes the unmasked dielectric film 2-5. After removing the remaining photoresist, the reusabe mandrel 2-9 has a patterned dielectric layer 2-13 resting on a stainless steel layer 2-15, as shown in FIG. 2G. This reusable mandrel is ready for fabricating devices.

Figure 3A:
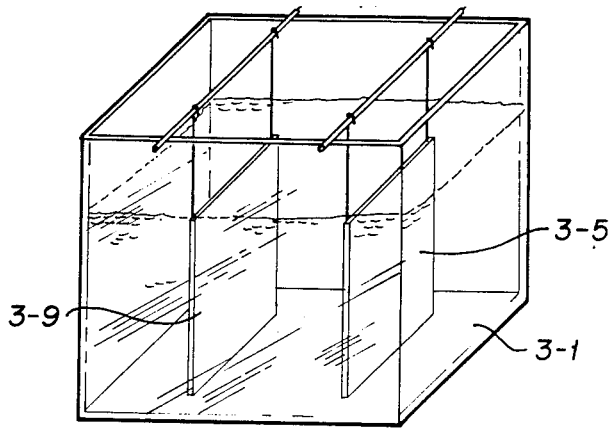
FIGS. 3A–3B show a device being manufactured by the reusable mandrel.
Figure 3B:
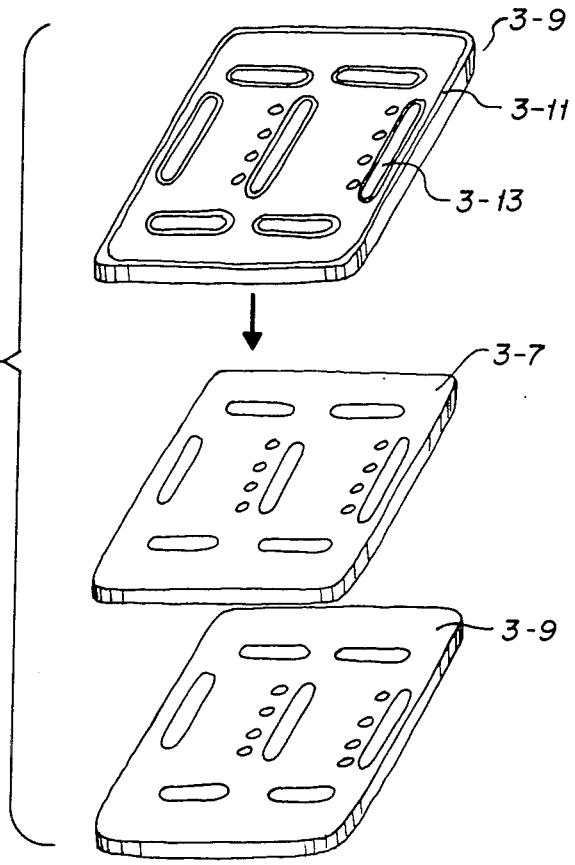

In order to manufacture a device using the reusable mandrel, insert the mandrel into an electroforming bath 3-1 shown in FIG. 3A. This reusable mandrel becomes the cathode 3-9. The source material plate 3-5 which supplies the electroforming material is the anode. In the preferred embodiment of the invention, the metal plate 3-5 is composed of nickel. During the electroforming process metal is transferred from the anode metal plate 3-5 to the cathode mandrel 3-9. The metal attaches to the conductive areas of the cathode mandrel 3-9. Thus, metal attaches to the conductive film layer 3-11, but not to the patterned dielectric areas 3-13. The electroforming process is continued until the device 3-7 has the desired thickness. When that point is reached, the device 3-7 is separated from the cathode mandrel 3-9 as shown in FIG. 3B.

Figure 4A:
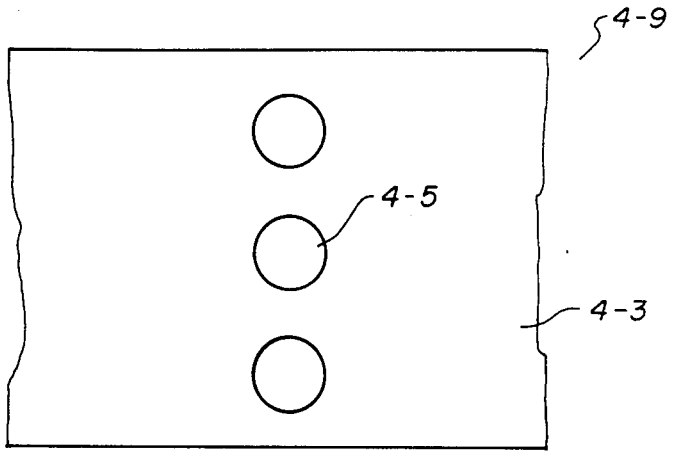
FIGS. 4A–4C show an orifice plate being manufactured by the reusable mandrel.
Figure 4B:
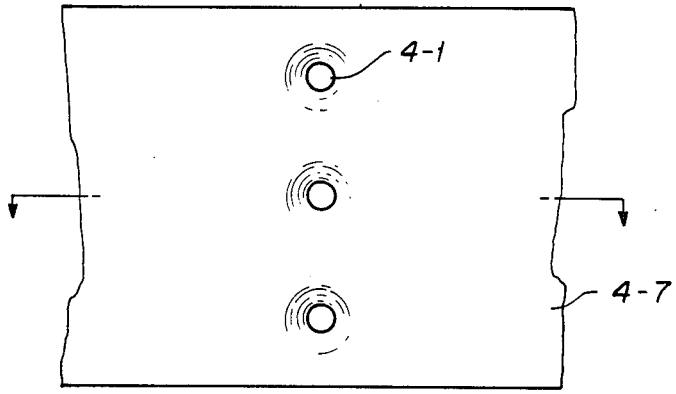
Figure 4C:
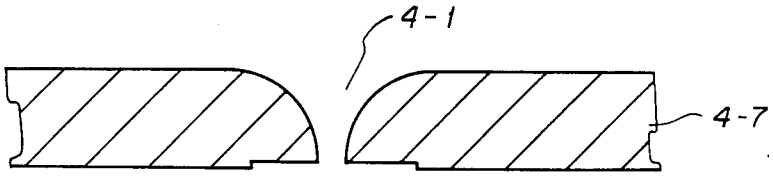

A reusable mandrel 4-9 for fabricating orifice plates 4-7 is shown in FIG. 4A. The mandrel 4-9 has a chrome/stainless steel thin film 4-3. Upon this film 4-3 lies the silicon nitride pattern 4-5 for forming the orifice plates 4-7. Once this mandrel has been electroformed, the orifice plate 4-7 is formed as shown in FIG. 4B. FIG. 4C shows a cross section of the orifice plate 4-7 with the orifice 4-1.

Figure 5A:
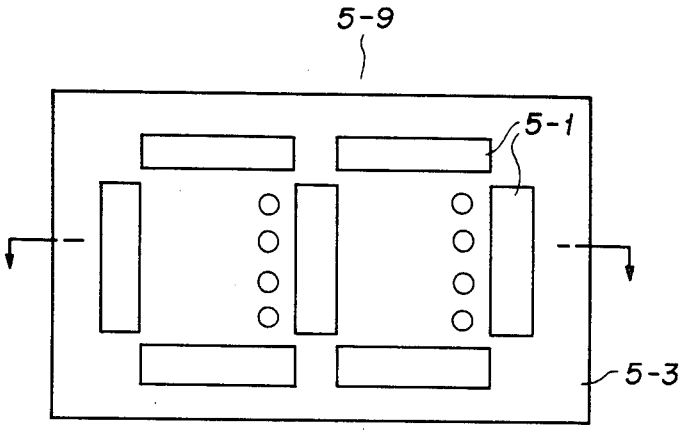
FIGS. 5A–5B show an etched thin film mandrel.
Figure 5B:
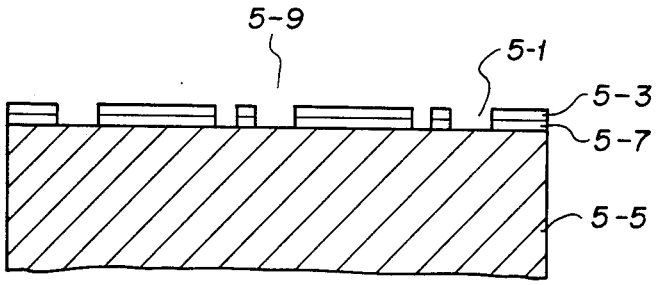

An etched thin film mandrel 5-9 in accordance with the present invention is shown in FIGS. 5A and 5B. The etched thin film mandrel 5-9 has a conductive film layers 5-3 such as gold film and 5-7 such as chrome layer deposited on a nonconductive smooth surface 5-5, such as glass substrate, polished silicon, or plastic 5-5. The chrome layer 5-7 adheres well to the substrate 5-5 and provides an adhesive surface for the gold layer 5-3. The gold layer 5-3 provides a conductive surface where the plating material, such as nickel, can deposit. The conductive film layers 5-3 and 5-7 have been etched with a pattern 5-1. This pattern 5-1 forms a mold for the device to be manufactured.

Figure 6A:
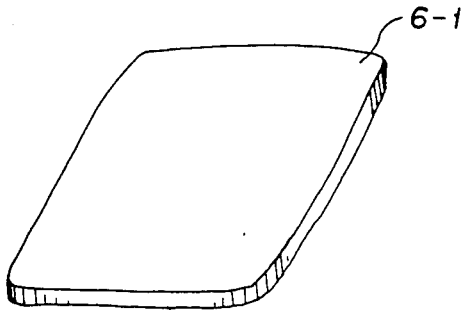
FIGS. 6A–6F show the steps used to manufacture an etched thin film mandrel.
Figure 6B:
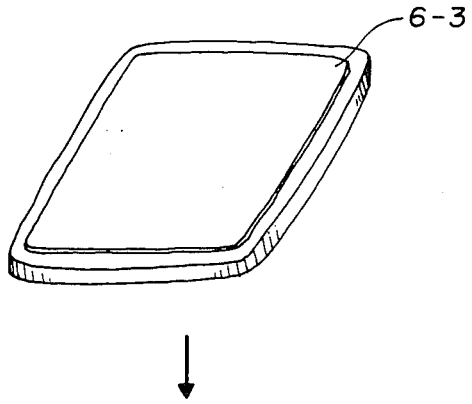
Figure 6C:
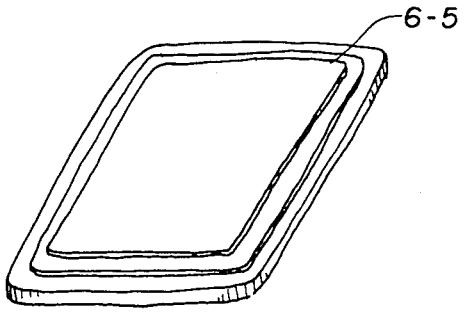
Figure 6D:
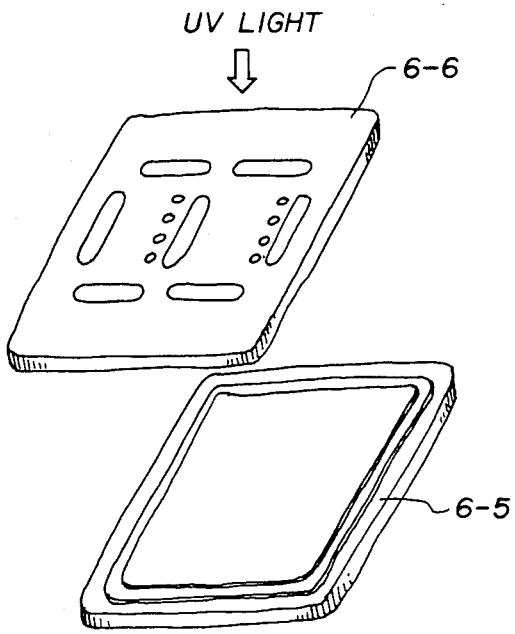
Figure 6E:
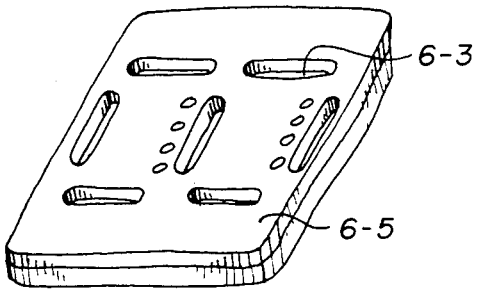
Figure 6F:
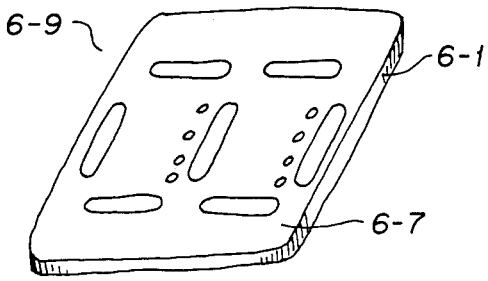

The method for manufacturing an etched thin film mandrel 5-9 in accordance with the present invention starts with a nonconductive smooth surface 6-1 such as glass substrate, silicon wafer, or plastic as shown in FIG. 6A. A vacuum deposition process, such as an evaporation process, deposits a conductive thin film 6-3 on to the substrate 6-1. The preferred embodiment of the invention uses a chrome/gold thin film. Next, on top of the conductive thin film 6-3, a photoresist layer 6-5 is deposited using a spinning process. Whether the photoresist layer 6-5 is positive or negative depends entirely on the photomask 6-6. The photomask 6-6 is placed next to the photoresist layer 6-5 and the combination is exposed to ultra-violet light as shown in FIG. 6D. The photomask 6-6 is removed and the photoresist layer 6-5 is developed so that the it obtains the pattern of the photomask 6-6 as shown in FIG. 6E. Next, an etching process such as sputter-etching or chemical etching etches the unmasked thin film layer 6-3. Once the photoresist layer 6-5 is stripped away, the etched thin film mandrel 6-9, as shown in FIG. 6F, is ready for use. The completed etched thin film mandrel 6-9 has a patterned chrome/gold layer 6-7 that exposes the substrate 6-1.

Figure 7A:
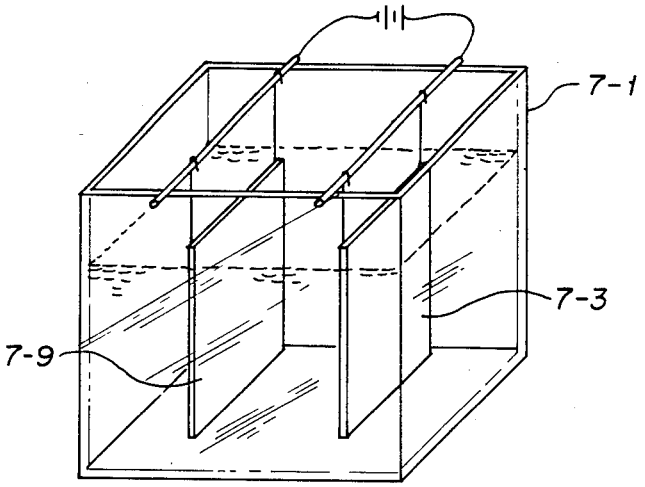
FIGS. 7A–7C show the steps used to manufacture a device using the etched thin film mandrel.
Figure 7B:
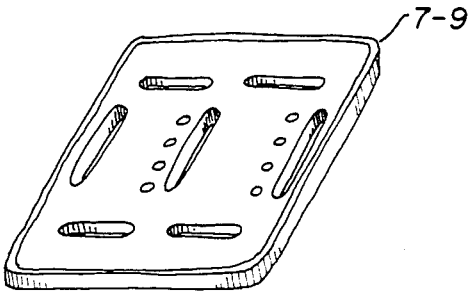
Figure 7C:
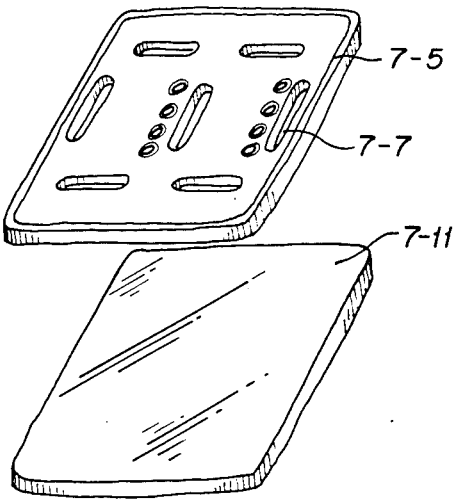

The process for fabricating devices with the etched thin film mandrel is very similar to the process for fabricating devices using the reusable mandrel. In order to manufacture a device using the etched thin film mandrel, an etched thin film mandrel 7-9 is inserted into an electroform bath 7-1, as shown in FIG. 7A. The thin film mandrel 7-9 becomes the cathode. The source material plate 7-3, which supplies the electroforming material, is the anode. Metal is transferred from the source material plate 7-3 to the mandrel 7-9. Since the metal attaches only to the conductive areas of the mandrel 7-9, duplicates of the patterned thin film layer are formed. The electroforming process is continued until a device of the desired thickness is produced. FIG. 7B shows the electroformed mandrel 7-9. The etched thin film layer of the mandrel 7-5 becomes a permanent part of the device 7-7 manufactured, as shown in FIG. 7C. The completed device 7-7 with the thin film layer 7-5 is separated from the glass substrate 7-11.

Figure 8A:
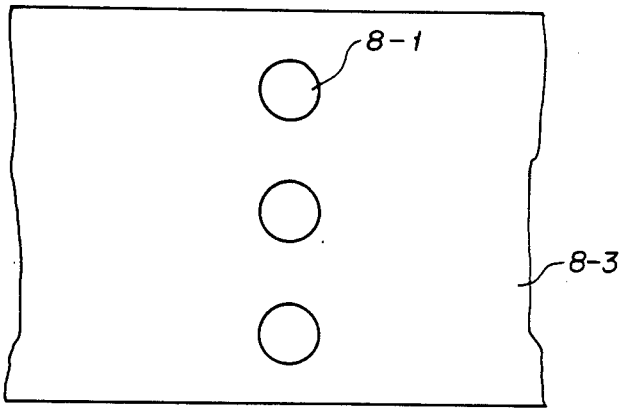
FIGS. 8A–8C show the steps used to manufacture an orifice plate using the etched thin film mandrel.
Figure 8B:
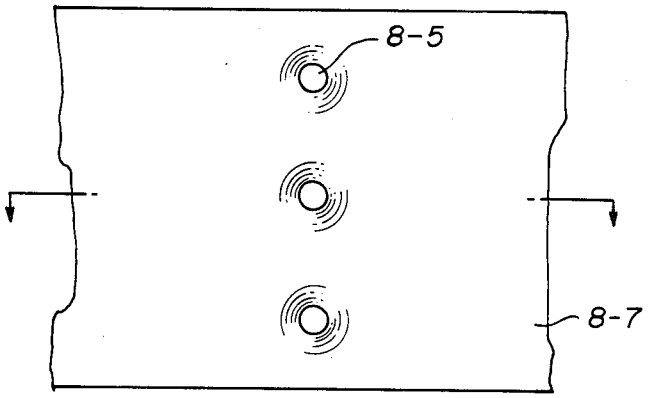
Figure 8C:
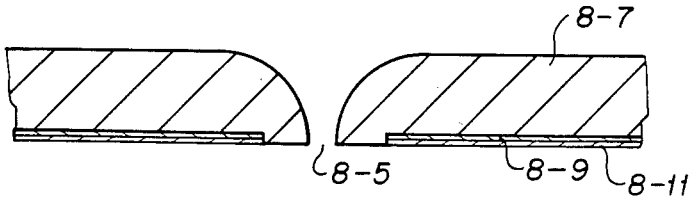

Thermal ink jet orifice plates are manufactured using an etched thin film mandrel. FIG. 8A shows an etched thin film mandrel 8-3 with the etched orifice pattern 8-1. After electroforming, the thin film mandrel 8-3 is coated with nickel 8-7 as shown in FIG. 8B. A cross section of the orifice plate is shown in FIG. 8C. The nickel plated layer is represented by 8-7, the gold layer is represented by 8-9, the chrome layer is represented by 8-11, and the orifice is represented by 8-5.

In addition to manufacturing thermal ink jet orifice plates, the etched thin film mandrel and the reusable mandrel can be used to manufacture a wide variety of devices.

We claim:

1. A mandrel comprising:

a substrate;

an etched chromium layer residing on said substrate;

an etched gold layer residing on said etched chromium layer; and wherein the gold layer resides directly on the unoxided surface of said chromium layer.

2. A mandrel as in claim 1 wherein said etched chromium layer and said etched gold layer are identically etched.

3. A method of making a mandrel comprising the steps:

depositing a chromium film layer on a substrate in a vacuum;

depositing a gold film layer on said chromium film layer in said vacuum;

depositing a photoresist layer on said gold film layer;

positioning a photomask having a pattern on said photoresist layer;

exposing said photomask and said photoresist layer to ultraviolet light;

developing said photoresist layer to produce said photomask pattern on said gold film;

etching portions of said gold film layer exposed by said photomask;

etching portions of said chromium layer underneath the etched portions of said gold film layer to form an etched conductive film mold; and stripping the remaining photoresist layer to complete construction of said mandrel.

4. A method of making a mandrel as in claim 3 wherein depositing a conductive film layer further comprises depositing said conductive film layer with a vacuum deposition process.

5. A method of making a mandrel as in claim 3 wherein depositing said photoresist layer further comprises using a spin coating process.

6. A method for making a mandrel as in claim 3 wherein the step etching portions of said gold film layer uses a chemical wet etching process, a sputter etching process, or a reactive ion etching process.

7. A method as in claim 3 for manufacturing devices comprising the steps of:

depositing material on the etched gold film;

removing said deposited material and said etched gold film layer from said mandrel; and wherein said etched gold film layer and said device separate from said substrate to complete the manufacturing of said device.

8. A mandrel comprising:

a glass substrate;

an adhesion sheet layer deposited on said glass substrate;

a stainless steel sheet layer deposited on said adhesion layer;

a photolithographically patterned and etched silicon nitride layer; and wherein said stainless steel sheet layer and said silicon nitride sheet layer form the molding surfaces of said mandrel.

* * * * *